US012116153B2

(12) United States Patent
Fuergut et al.

(10) Patent No.: US 12,116,153 B2
(45) Date of Patent: Oct. 15, 2024

(54) METHOD AND DEVICE FOR PACKAGING FRESH PRODUCTS

(71) Applicant: ALBERT HANDTMANN MASCHINENFABRIK GMBH & CO. KG, Biberach (DE)

(72) Inventors: Michael Fuergut, Biberach (DE); Peter Willburger, Baindt (DE); Martin Staudenrausch, Biberach (DE); Thomas Wenk, Ulm (DE)

(73) Assignee: ALBERT HANDTMANN MASCHINENFABRIK GMBH & CO. KG, Biberach (DE)

( * ) Notice: Subject to any disclaimer, the term of this patent is extended or adjusted under 35 U.S.C. 154(b) by 0 days.

(21) Appl. No.: 17/326,220

(22) Filed: May 20, 2021

(65) Prior Publication Data

US 2021/0362892 A1 Nov. 25, 2021

(30) Foreign Application Priority Data

May 25, 2020 (EP) ..... 20176317

(51) Int. Cl.

| | |
|---|---|
| ***B65D 81/26*** | (2006.01) |
| ***B65B 25/06*** | (2006.01) |
| ***B65B 35/22*** | (2006.01) |
| ***B65B 35/24*** | (2006.01) |

(52) U.S. Cl.

CPC ..... *B65B 25/067* (2013.01); *B65B 35/22* (2013.01); *B65B 35/243* (2013.01); *B65D 81/267* (2013.01)

(58) Field of Classification Search

CPC ..... B65B 25/067; B65B 35/243; B65B 35/22; B65D 81/267

See application file for complete search history.

(56) References Cited

U.S. PATENT DOCUMENTS

| | | | | |
|---|---|---|---|---|
| 4,275,811 | A * | 6/1981 | Miller | B65D 81/264 426/396 |
| 4,382,507 | A * | 5/1983 | Miller | B65D 81/264 206/204 |
| 4,410,578 | A * | 10/1983 | Miller | B32B 29/007 428/117 |
| 4,421,222 | A | 12/1983 | Stuermer | |
| 5,320,895 | A * | 6/1994 | Larsonneur | B65D 81/264 428/323 |
| 6,479,061 | B2 * | 11/2002 | Fontenot | B32B 5/08 428/221 |

(Continued)

FOREIGN PATENT DOCUMENTS

| | | | |
|---|---|---|---|
| AU | 2005202390 | A1 | 12/2005 |
| JP | S6034370 | A * | 2/1985 |
| JP | 3023379 | U | 4/1996 |

(Continued)

OTHER PUBLICATIONS

Japanese Patent Office, Office Action Issued in Application No. 2021-08176, May 31, 2022, 20 pages.

(Continued)

*Primary Examiner* — Andrew M Tecco

(74) *Attorney, Agent, or Firm* — McCoy Russell LLP

(57) ABSTRACT

A method and a device for packaging fresh products, in particular meat and sausage products, where the fresh product is introduced into a container simultaneously with an absorbent base.

10 Claims, 4 Drawing Sheets

(56) References Cited

U.S. PATENT DOCUMENTS

2002/0141898 A1* 10/2002 Carlucci ..... A61L 9/01
442/101
2011/0195165 A1 8/2011 Cahill

FOREIGN PATENT DOCUMENTS

JP 2000300227 A 10/2000
KR 20130015896 A 2/2013

OTHER PUBLICATIONS

Japanese Patent Office, Office Action Issued in Application No. 2021-081796, Jan. 4, 2023, 14 pages.

* cited by examiner

METHOD AND DEVICE FOR PACKAGING FRESH PRODUCTS

CROSS REFERENCE TO RELATED APPLICATION

The present application claims priority to European Patent Application No. 20176317.4 filed on May 25, 2020. The entire contents of the above-listed application is hereby incorporated by reference for all purposes.

TECHNICAL FIELD

The invention relates to a method and a device for packaging fresh products.

BACKGROUND AND SUMMARY

In the production of fresh products, such as ground meat, burgers, patties, fresh sausages, etc., moisture-absorbing absorbent bases, e.g. so-called nonwoven materials, are placed into the packaging so that excess moisture is bound. This prevents, firstly, liquid from becoming visible in the packaging and, secondly, the inner side of the packaging from fogging up and thus the packaged food no longer being clearly visible.

After the production of packaging trays (trays) in a separate step, such absorbent bases are loosely inserted or glued or welded into the former (e.g. by way of ultrasonic welding). The trays are then stacked and delivered to future customers (e.g. ground meat production companies, etc.). There, the trays are then unstacked again, filled, and closed.

Absorbent bases have hitherto always been introduced into the tray or the packaging in a separate production step (not simultaneously with the product). The introduction of the absorbent base cuttings into the tray and the subsequent stacking, storage, transportation and unstacking again can result in hygienic problems because surfaces in contact with food can be contaminated. The existing solution is inflexible because the absorbent base, i.e., e.g. the nonwoven material, is introduced into the tray in advance. In the event that a producer packs different products into one tray format and would like to use the absorbent base that is appropriate for the respective product (different sizes, thicknesses, absorption capacities/absorption properties), then he would have to stock identical trays with different inserts. This entails higher expenditure for storage space, the risk of mix-up, and higher unit costs, since lower respective quantities are required for each. In practice, therefore, nonwoven inserts which actually do not ideally fit the respective product are often used today. Inserts with too little or too much absorption capacity are possibly used (as a result of which an absorbent base that is more expensive than is actually necessary is often used).

Starting out from there, the present disclosure is based on the object of providing a method and a device for packaging fresh products which bring about improved hygiene and, moreover, are less expensive to manufacture and store.

According the present disclosure, a method for packaging fresh products, in particular meat and sausage products, is therefore provided, where the fresh product is introduced into a container simultaneously with an absorbent base. Simultaneously is presently understood to mean in one step, i.e. that the fresh product is already disposed above the absorbent base when the fresh product is placed into the container. In prior art, there were always at least two separate process steps for this.

The disclosure has the advantage that containers, such as bowls, trays, etc., no longer have to be stored together with the absorbent bases. This also entails the further advantage that an ideally suitable absorbent base can always be selected for a specific product. The containers can then be purchased and stored in larger quantities independently of the respective absorbent bases, which entails economic advantages. Furthermore, there are also hygienic advantages, since the absorbent base does not have to be stored together with the container, in particular surfaces that contact the food are not contaminated. This also means that containers and absorbent bases can be purchased independently of each other.

An absorbent base in this application is understood to be a base that can absorb moisture and has an absorbent body, e.g. a nonwoven material, e.g. made of cellulose. The absorbent base can be formed by the absorbent body or comprise such. In this application, a container is understood to be a tray, a deep-drawn packaging, a flow wrap packaging (tubular bag), a cardboard box, etc.

A further advantage of the present disclosure is that a production step can be saved over prior art, since the absorbent base can be introduced together with the product.

According to an example embodiment, an intermediate layer can be arranged between the absorbent base and the fresh product, in particular paper, e.g. wax paper having a smooth surface or film material, in particular a plastic film, e.g. a PE film. For example, a fresh product can then be produced on the intermediate layer, e.g. a strand of ground meat. If the intermediate layer is further disposed between the absorbent base and the fresh product, then the product can be prevented from drying out due to being in direct contact with the absorbent base, e.g. the absorbent nonwoven material. This is particularly advantageous if the absorbent base comprises an absorbent body, in particular in the form of nonwoven material, the surface of which facing the fresh product absorbs moisture. An intermediate layer additionally entails the further advantage that the absorbent base disposed therebeneath, which may have already absorbed liquid, e.g. blood, is not visible, which leads to an improved appearance. Furthermore, if the absorbent base has a rough surface, then the fresh product can more easily be removed from the intermediate layer, which can have a smooth surface, and does not stick. The intermediate layer is advantageously made from a material that does not absorb liquid.

Alternatively, the absorbent base can also be configured such that plastic material is applied, in particular laminated, onto the absorbent body on at least on one side.

The absorbent base may be configured such that the contact surface facing the fresh product cannot absorb any moisture via the absorbent body. This means that, if a plastic film is applied onto the absorbent body, then the plastic material is also not perforated on the side of the contact surface. If both sides of the absorbent body are provided with plastic material, then the underside facing away from the fresh product may be perforated in such a way that liquid can be absorbed via the absorbent body.

A corresponding configuration in which the contact surface facing the fresh product is not moisture-absorbing entails the advantage that the fresh product does not dry out, and then no intermediate layer may be necessary.

Advantageously, the absorbent base is drawn from a roll, e.g. in the form of a web, and conveyed in the direction of transport by a transport device, e.g. a conveyor belt. The fresh product that has been applied onto the absorbent base is also conveyed in direction of transport T together with the absorbent base. If an intermediate layer is present, it is also possible for the absorbent base and the intermediate layer to be drawn from a common roll or else from two different rolls. If the absorbent base and the intermediate layer are drawn off from different rolls, then they do not have to have the same length (when viewed in the direction of transport) if they are cut at different points. The absorbent base drawn off and the intermediate layer are conveyed in the direction of transport, where the fresh product is then applied onto the intermediate layer.

The fresh product can advantageously first be applied onto the intermediate layer and thereafter the absorbent base can be introduced under the intermediate layer, or the intermediate layer and the absorbent base have already been placed on top of one another and moved in the direction of transport when the fresh product is deposited thereonto.

The absorbent base and/or the intermediate layer can be severed into individual cuttings before being introduced into the container, optionally also together with the product, e.g. a strand of ground meat. It is therefore possible to sever the absorbent base and/or the intermediate layer, i.e. the web, before or after the fresh product has been applied.

According to an example embodiment, the method according to the disclosure enables the cut absorbent base to have a smaller area than the cut intermediate layer, in particular a shorter length, such that the amount of expensive absorbent base can be reduced. In addition, the absorbent base under the intermediate layer cannot be seen from above, which can lead to an improved appearance. An intermediate layer is particularly advantageous because the fresh product, e.g. ground meat, can be removed more easily from the smooth intermediate layer by the end consumer than from the absorbent base which has a rough surface.

It is also possible that the absorbent base and the intermediate layer are connected to one another, i.e. attached to one another, e.g. glued, welded, etc., prior to the application of the fresh product. The absorbent base and the intermediate layer can be connected to one another in advance and wound onto a common roll, or the absorbent base and the intermediate layer are joined and connected to one another after being drawn off.

The device according to the disclosure comprises at least one feed device for an absorbent base which in particular comprises a roll, and a feed device for the fresh product, e.g. an ejector device for ground meat, a conveyor belt for a strand of fresh product or portioned fresh products, etc.

The device is configured in such a way that the fresh product, i.e. the portioned fresh product, can be introduced into a container together with the absorbent base.

The device can also have a feed device for an intermediate layer, which comprises in particular a roll.

According to an example embodiment, the device comprises a transport device with which the fresh product lying on the absorbent base or on the absorbent base and the intermediate layer can be transported prior to being introduced into the container.

Furthermore, the device comprises at least one separating device for separating the absorbent base web and the intermediate layer web into respective cuttings. The device is configured for the simultaneous introduction of the fresh product with the absorbent base and for this purpose advantageously comprises a transport device for transporting the containers which is disposed lower than the transport device on which the fresh product is conveyed together with the absorbent base or the absorbent base and the intermediate layer, such that the fresh product together with the absorbent base or the absorbent base and the intermediate layer can be dropped or introduced into the container (e.g. into a tubular bag). The fresh product can simply run off the belt at the end of the transport device, in particular a conveyor belt, and drop or slide into the container or can be pushed off by use of a pusher. For this purpose, the container wall can run at an angle to the container base. It is also possible to arrange a slide at the end of the transport device, e.g. at the rear end of a conveyor belt when viewed in the direction of transport, over which the fresh product and the absorbent base can slide into the container.

BRIEF DESCRIPTION OF THE FIGURES

The present disclosure shall be explained hereafter in more detail with reference to the following figures.

DETAILED DESCRIPTION

Figure 1A:
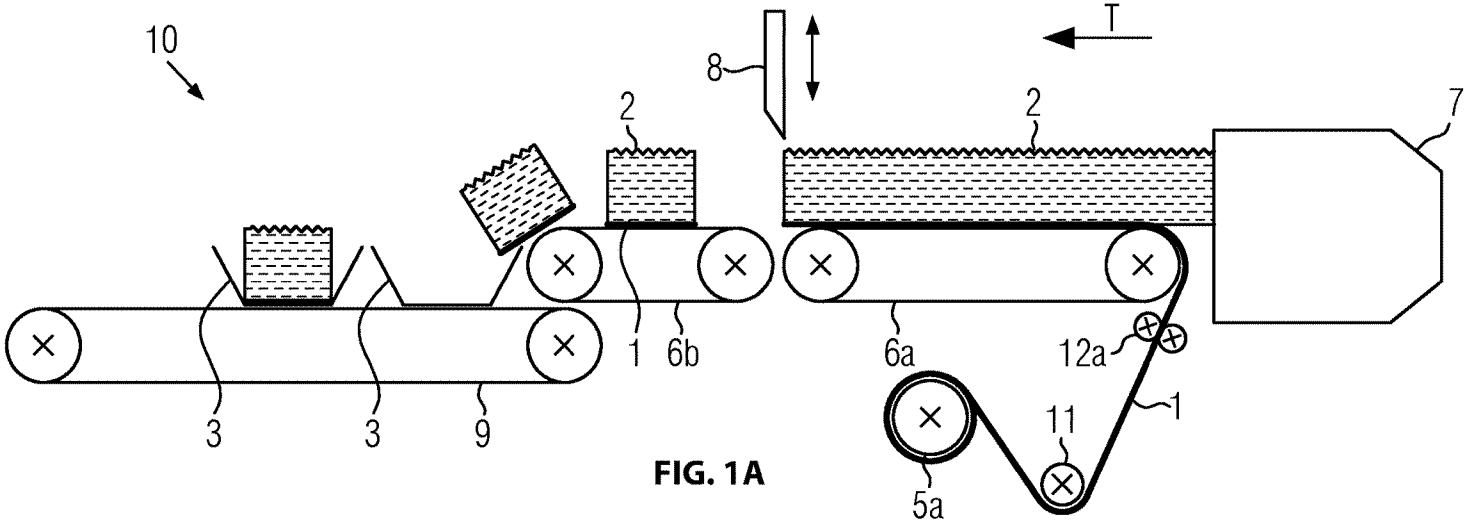
FIG. 1A shows a simplified schematic representation of an embodiment according to the present disclosure.

FIGS. 1A, 1B, 2 and 3 show embodiments of the present disclosure using the example of ground meat production. Fresh product 2, presently in the form of ground meat 2, is ejected from schematically illustrated meat grinder 7 in direction of transport T as a strand of ground meat and is transported onward in the direction of transport on a first transport device, presently conveyor belt 6*a*. Meat grinder 7 presently serves as device 7 for supplying fresh product 2, presently the strand of ground meat.

Furthermore, device 10 comprises a feed device, which presently comprises a roll 5*a*, via which an absorbent base 1, presently in the form of an absorbent base web, can be drawn off. The absorbent base or the absorbent base web can presently be led, e.g. by way of a guide that can comprise e.g. a deflection roller 11 and a pair of rollers 12*a*, to the leading end of a transport device 6*a*, presently, conveyor belt 6*a*. A drive can be provided which, for example, drives at least one roller of pair of rollers 12*a* and/or roll 5*a* for conveying the absorbent base web. Absorbent base 1 is there led over the leading end of the conveyor belt, where fresh product 2 is produced onto conveyor belt 6*a* and absorbent base 1 is carried along between the conveyor belt and fresh product 2. A control device, not shown, controls the drives of the feed device for the absorbent base and the drive of the conveyor belt, for example, synchronously. Disposed at the end of conveyor 6*a* is a conveyor 6*b*, presently likewise in the form of a circulating conveyor belt. In at least one example, the control device may comprise instructions stored in non-transitory memory that are executable to control the drives of the feed device.

Provided between conveying devices 6*a* and 6*b*, which are spaced apart, is a separating unit in the form of a knife 8 which severs product 2 as well as absorbent base 1. Conveyor belt 6*b* then conveys fresh product 2 onward on the absorbent base in the direction of transport. Arranged in a region below transport device 6*b* is a transport device 9, presently likewise configured e.g. as a circulating conveyor belt. Conveying device 9 for transporting containers 3 is arranged in such a way that conveying devices 9 overlap in direction of transport T such that fresh product 2 can drop or slide together with absorbent base 1 into a container 3 at the end of conveying device 6*b*. As shown in FIG. 1A, the container can have an inclined wall, or a slide (not shown) is provided which is arranged in such a way that fresh product 2 can slide together with absorbent base 1 into container 3. This is gentle on the product and minimizes the drop height. Conveyor belt 6*b* downstream of separating device 8 can run faster than transport device 6*a* in order to create a gap between the individual portions. At this point, the portions can also be placed with a retraction belt into a deep-drawing machine or into a horizontal tubular bag machine.

The fresh product can also be pushed with the absorbent base into the respective container.

In the embodiment shown in FIG. 1A, containers 3 can alternatively also be transferred, e.g. onto a conveying device, e.g. B. a conveyor belt that runs perpendicular to direction of transport T (not shown), in particular, be pushed thereonto, etc.

Guided containers 3 can then be transported, e.g. onward in direction of transport T and subsequently closed.

Absorbent base 1 comprises an absorbent body, for example, a material that can absorb moisture, such as. B. nonwoven material, in particular cellulose. The absorbent body has, for example, an absorbency of up to 4000 ml/m$^2$.

The absorbent base is e.g. 0.2 mm-4 mm thick and can also have a cushioning effect when appropriately thick.

It is also possible that the absorbent base is configured such that it is not formed exclusively by a moisture-absorbing absorbent body, but that, e.g. plastic material e.g. a PE film (polyethylene) having a thickness of 0.05-0.5 mm is applied on at least one side, in particular laminated thereonto. At least the contact surface on which fresh product 2 rests on absorbent base 1 may be configured such that no liquid can be absorbed in order to prevent the fresh product from drying out. If the absorbent base comprises plastic material on the side facing fresh product 2 and on the underside, then the plastic material can be perforated on the underside in such a way that liquid can be absorbed by the underside. The speeds of individual transport devices 6*a*, 6*b*, 9 as well as the drive of the feed of the absorbent base web and the speed of ejection of the fresh product can be adjusted by way of a control device (not shown). In at least one example, the control device may comprise instructions stored in non-transitory memory that are executable to control the speeds of the individual transport devices, the drive of the feed of the absorbent base web and the speed of ejection of the fresh product.

Figure 1B:
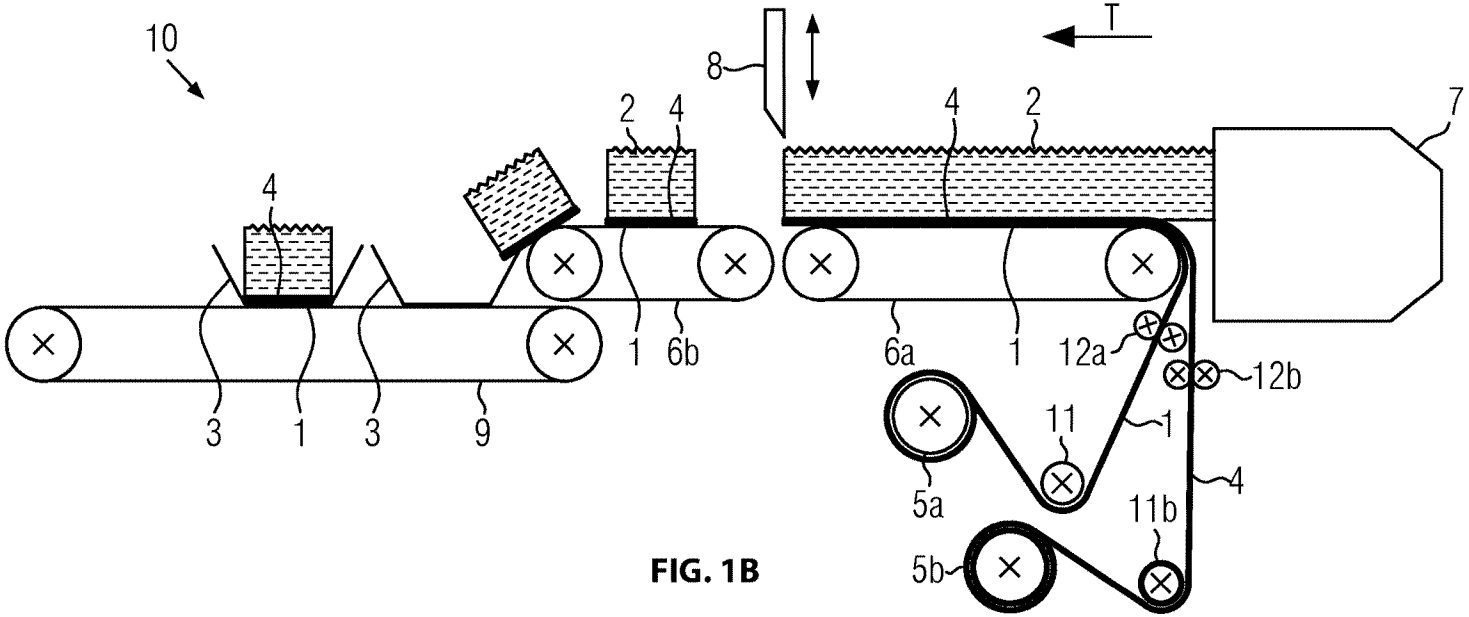
FIG. 1B shows a simplified schematic representation of a further embodiment according to the present disclosure.

FIG. 1B shows a further embodiment according to the present disclosure which corresponds substantially to the embodiment shown in FIG. 1A, where only an intermediate layer 4 can there further be arranged between the fresh product and absorbent base 1. For this purpose, e.g. a second roller 5*b* is provide, which can also be led by way of a guide device, for example, by way of a deflection roller 11*b* and pair of rollers 12*b* as an intermediate layer web 4 to the beginning of transport device 6*a* in a region above absorbent base 1. The feed for the intermediate layer can there also have a drive, where, for example, at least one roller of pair of rollers 12*b* is driven. Fresh product 2 is then applied onto intermediate layer 4. This means that intermediate layer 4 is arranged between fresh product 2, presently the strand of ground meat, and absorbent base 1.

Intermediate layer 4 is, for example, paper, waxed paper, or film material, e.g. a PE film or a PS film (polystyrene). The intermediate layer may be configured such that it does not absorb any moisture. The remainder of the device corresponds to the device described in FIG. 1A, where fresh product 2 can then also be introduced into container 3 together with absorbent base 1, but where intermediate layer 4, which is likewise cut, is arranged between absorbent base 1 and finished product 2.

In the embodiments shown in FIGS. 1A and 1B, absorbent base web 1 and intermediate layer web 4 are jointly separated together with the ground meat to the desired size, i.e. to length when viewed in direction of transport T. The three components therefore always have the same length. The width of the three components, however, can differ; i.e., intermediate layer 4 can be e.g. wider than ground meat portion 2, and absorbent base 1 can be narrower than intermediate layer 4 so that the absorbent base is no longer visible to the end customer in the finished packaging. In this way absorbent base material can be saved if the area of the absorbent material is smaller than the area of intermediate layer 4.

In the embodiment shown in FIG. 1B, the absorbent base can of course be formed exclusively by the absorbent body or, as has been described in connection with FIG. 1A, also be formed on at least the contact side in such a way that no liquid is absorbed. This is particularly advantageous when the intermediate layer is formed from uncoated paper by which liquid could be absorbed.

In order to prevent a relative motion between the intermediate layer and the absorbent base on the way into the packaging, i.e. container 3, both layers can be connected to one another after being drawn off from rolls 5*a* and *b* and before they are placed under the fresh product. The connection can be established by applying adhesive, in particular one or more points of adhesive on the intermediate layer and/or absorbent base 1 on the respective sides facing each other or by adhesive bonding using self-adhesive strips on the intermediate layer or the absorbent base. A connection can also be established by way of ultrasonic welding in a stationary manner or in a continuous flow or by way of an embossed connection in a stationary manner or in a continuous flow.

Figure 2:
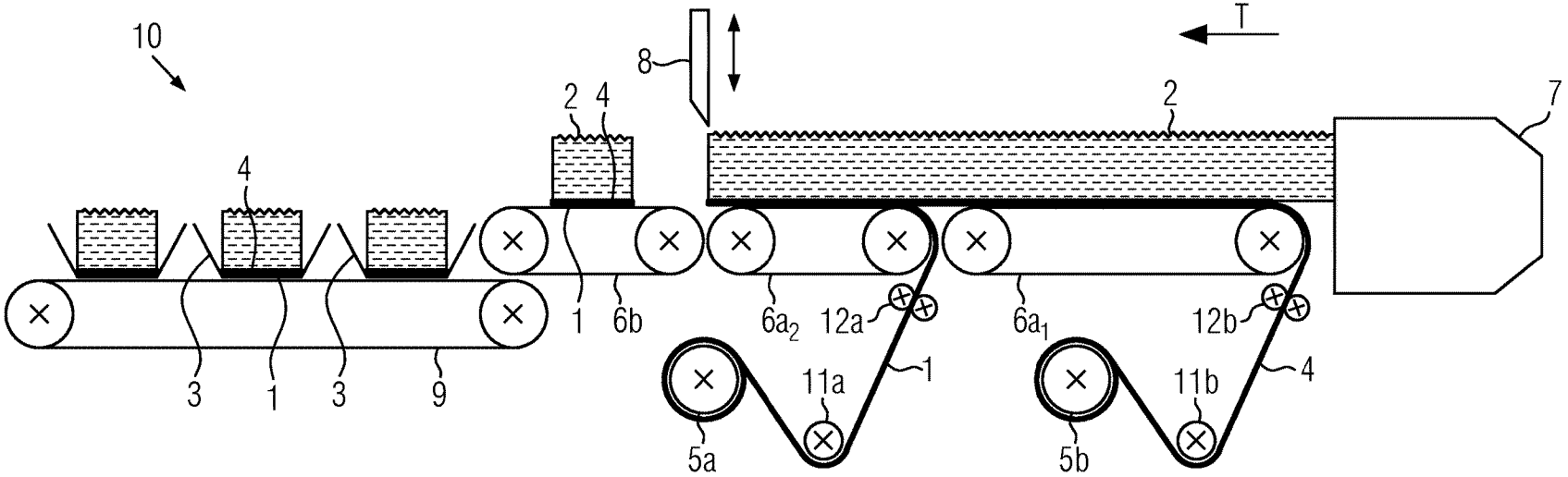
FIG. 2 shows a simplified schematic representation of a further embodiment according to the present disclosure.

FIG. 2 corresponds substantially to the embodiment shown in FIG. 1B with the exception that absorbent base 1 and intermediate layer 4 are supplied at different points. In the embodiment shown in FIG. 2, transport device 6*a* is there subdivided into transport devices $\mathbf{6}a_1$, $\mathbf{6}a_2$.

Absorbent base web 1 is there fed between transport devices $\mathbf{6}a_1$ and $\mathbf{6}a_2$ and introduced beneath fresh product 2 and intermediate layer 4.

In FIG. 2, the connection between intermediate layer 4 and absorbent base can be effected e.g. by way of self-adhesive strips on the upper side of the absorbent base or the underside of the intermediate layer. In this arrangement as well, the three components (fresh product, intermediate layer, absorbent base) are separated to the same length, while, as described above, the widths can differ. The further course of the production line corresponds to that in FIGS. 1A and 1B.

Figure 3:
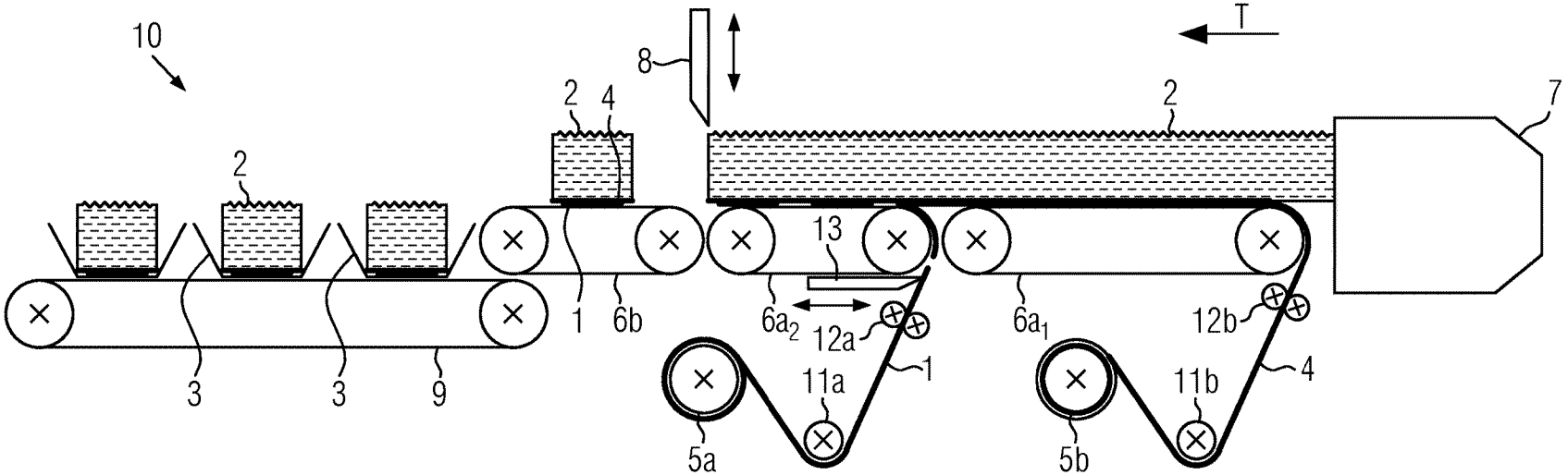
FIG. 3 shows a simplified schematic representation of a further embodiment according to the present disclosure.

FIG. 3 shows an embodiment which corresponds to the embodiment shown in FIG. 2, where absorbent base 1 is fed between transport devices $\mathbf{6}a_1$ and $\mathbf{6}a_2$. In this embodiment, an additional separating device 13 is provided which is arranged e.g. immediately downstream of pair of rollers 12 and in which at least one roller is driven in order to feed the absorbent base web to transport device $\mathbf{6}a_2$. Separating device 13 can there already divide the absorbent base into individual parts before it is placed under intermediate layer 4. Absorbent base 1 can then always be pulled along by way of pair of transport rollers 12*a*.

This embodiment has the advantage that the length (when viewed in direction of transport T) of intermediate layer 4 and absorbent base 1 can differ. Therefore, not only can the width of intermediate layer 4 and absorbent base 1 be selected differently, but also their length. The size of the absorbent base can then be adapted to the needs of the product.

Figure 4:
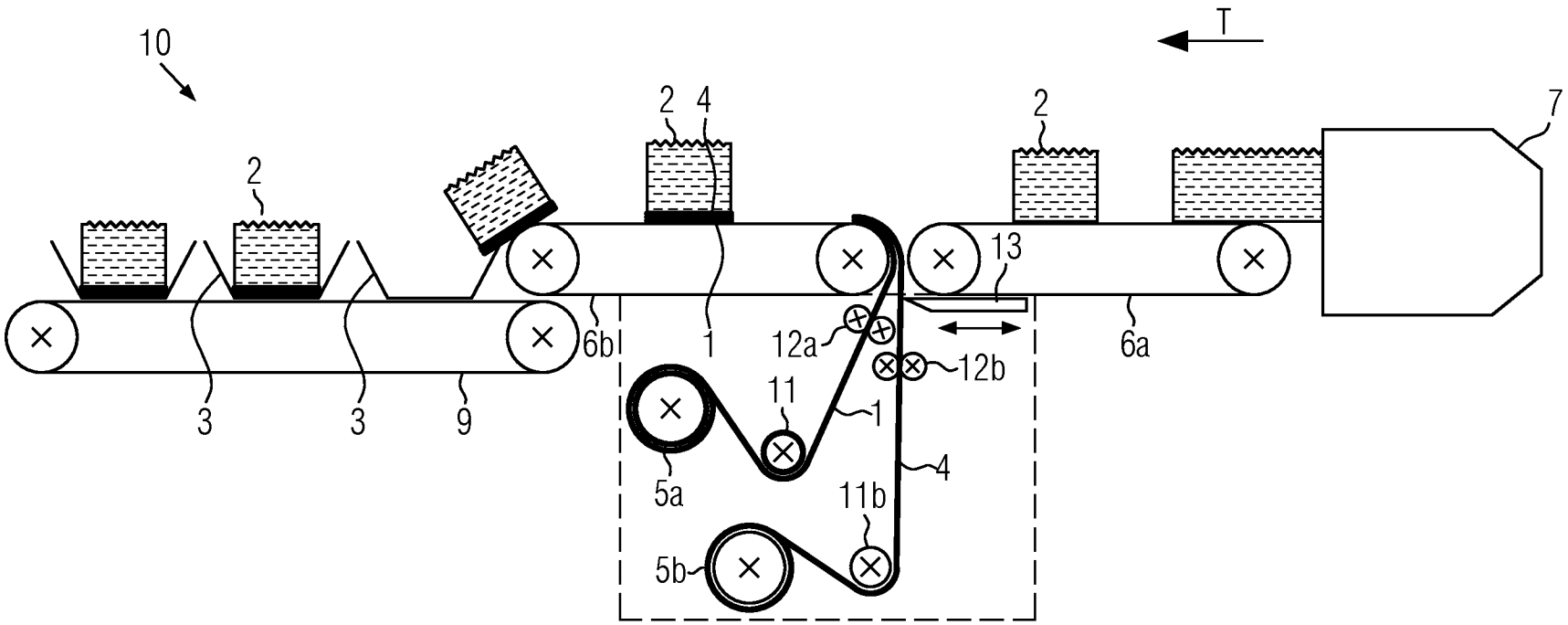
FIG. 4 shows a simplified schematic representation of a further embodiment according to the present disclosure.

FIG. 4 shows a further embodiment in which already separated portions of fresh product 2, such as burgers, patties, groups of fresh sausages, etc., are supplied. Ground meat portions already separated by an upstream process are conceivable as well. For example, the ground meat can there be ejected in portions. The individual portions are transported spaced apart on conveyor belt 6*a*. According to this embodiment, both absorbent base 1 and intermediate layer 4 are fed between transport device 6*a* and 6*b*, as described above. Alternatively, it is also possible to feed only an absorbent base. Absorbent base 1 and intermediate layer 4 are there separated by separating device 13, e.g. to the same length. It is not imperative that absorbent base 1 and intermediate layer 4 be separated to the same length, since different lengths can be produced by different advance rates. The rear edge of the intermediate layer and the absorbent base are then separated at the same point. Although not shown, absorbent base 1 and intermediate layer 4 can also be longer than the product and project over the product at the front and/or back. Divided fresh product 2 is then pushed onto intermediate layer 4 and absorbent base 1 at the transition between two transport devices 6*a* and 6*b*, transported onward in direction of transport T, and finally, as described above, placed or inserted into respective container 3.

Figure 5:
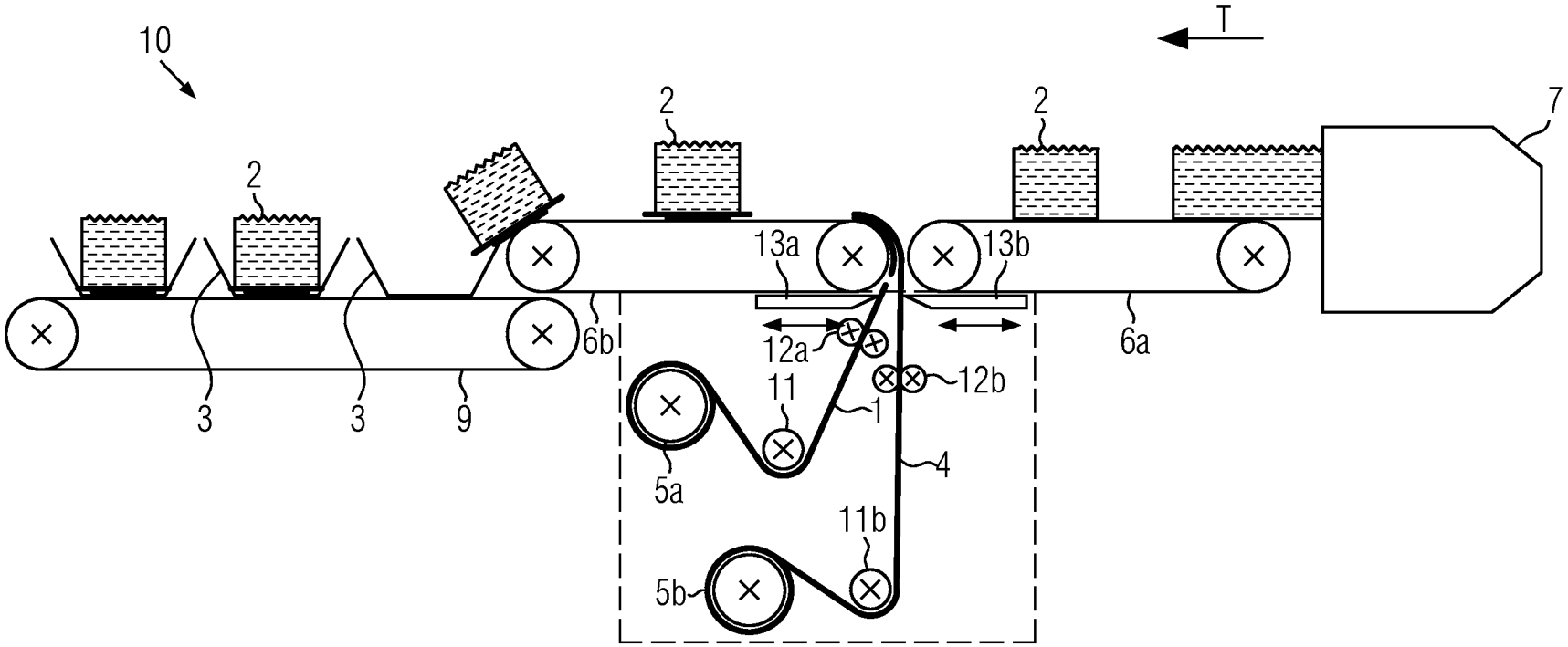
FIG. 5 shows a simplified schematic representation of a further embodiment according to the present disclosure.

FIG. 5 corresponds substantially to the embodiment shown in FIG. 4 with the exception that two different separating devices 13*a* and 13*b* are provided for absorbent base 1 and intermediate layer 4. Feed rollers 12*a*, 12*b* can also be actuated separately from one another at different speeds. This provides the advantage that the length of intermediate layer 4 and absorbent base 1 can be set completely independently of one another and can be fed to fresh product 2 at different lengths. The position of intermediate layer 4 relative to fresh product 2, but also the position of absorbent base 1 relative to fresh product 2 or to intermediate layer 4, can then be adjusted. Here as well, the size of absorbent base 1, and therefore the absorption of moisture, can be adapted very well to the product. In order to prevent the bases from slipping relative to one another, e.g. a self-adhesive strip can be provided on one or both bases. However, in the region where intermediate layer 4 and absorbent base 1 are joined, it is also possible that an adhesive is applied between them, or absorbent base 1 and intermediate layer 4 are connected to one another by way of an ultrasonic welding device (not shown) or an embossing device (not shown) as also described above. The onward transportation of the products is effected as described above.

In the method according to the disclosure, a strand of fresh product 2 or an already divided fresh product is supplied and at least one absorbent base 1 is placed underneath, or an intermediate layer as well as an absorbent base. Absorbent base 1 or the absorbent base and intermediate layer 4 are cut to a desired length by a cutting device 8, 13 during the ongoing process. Absorbent base 1 and intermediate layer 4 can either be cut together and then have the same length or are supplied separately by separate devices such that they differ in length. The length can then be adapted to specific requirements. A corresponding drive for conveying absorbent base 1 can then also be driven independently of a drive for conveying intermediate layer 4. In the event that the product is present in the form of a product strand, the latter can be separated either together with the absorbent base and/or optionally with intermediate layer 4. The fresh product can then be introduced into a container 3 together with the absorbent base or the absorbent base and intermediate layer 4 and transported onward and finally closed or welded shut, for example, by use of a lid or film material. In the case of a tubular bag or flow wrap packaging, the bag is sealed without additional film material. In at least one example, one or more of the devices discussed herein may comprise a control device, wherein the control device includes instructions stored in non-transitory memory that are executable to carry out the method of the present disclosure.

The invention claimed is:

1. A method for packaging fresh product, wherein said fresh product is introduced into a container simultaneously with an absorbent base, wherein an intermediate layer is arranged between said absorbent base and said fresh product prior to the introduction, wherein said absorbent base and said intermediate layer are each drawn off from a respective separate first roll and second roll and conveyed in a direction of transport and said fresh product is transported in said direction of transport, and when said fresh product is applied onto said intermediate layer, said absorbent base and said intermediate layer are separate layers, wherein the fresh product is introduced onto said intermediate layer drawn from the first roll and the absorbent base drawn from the second roll, wherein the absorbent base is added underneath both said fresh product and said intermediate layer, wherein a feed device for said absorbent base and a feed device for said intermediate layer comprise a guide, which is configured such that said absorbent base and said intermediate layer are drawn in between said product and the transport device from the respective separate first roll and second roll and transported along, and wherein said fresh product is introduced onto said intermediate layer drawn from the first roll, and wherein said absorbent base from the second roll is then added underneath both said fresh product and said intermediate layer.

2. The method according to claim 1, wherein said fresh product includes meat and sausage products.

3. The method according to claim 1, wherein said absorbent base is cut and then has a smaller area than the intermediate layer after it is cut, and the width and/or length of said cut absorbent base is shorter than the width and/or length of said cut intermediate layer.

4. The method according to claim 1, wherein said absorbent base comprises an absorbent body.

5. The method according to claim 1, wherein said absorbent base comprises nonwoven material.

6. The method according to claim 1, wherein said absorbent base is drawn off from said respective separate roll of said feed device for said absorbent base and is conveyed in said direction of transport, and said fresh product is applied with a further feed device onto said absorbent base and conveyed together with said absorbent base in said direction of transport.

7. The method according to claim 1, wherein said absorbent base and/or said intermediate layer are cut from respective web cuttings into individual cuttings before said fresh product and said absorbent base or said fresh product with said absorbent base and said intermediate layer are introduced into said container.

8. The method according to claim 1, wherein said absorbent base and/or said intermediate layer are fed at the beginning of a transport device, and conveyed along by said transport device in said direction of transport.

9. The method according to claim 1, wherein said intermediate layer is drawn from the first roll, wherein said absorbent base is drawn from the second roll, and wherein said first roll is upstream of said second roll in said direction of transport.

10. A method for packaging fresh product, wherein said fresh product is introduced into a container simultaneously with an absorbent base, wherein an intermediate layer is arranged between said absorbent base and said fresh product prior to the introduction, wherein said absorbent base and said intermediate layer are each drawn off from a respective separate first roll and second roll and conveyed in a direction of transport and said fresh product is transported in said direction of transport, and when said fresh product is applied onto said intermediate layer, said absorbent base and said intermediate layer are separate layers wherein the fresh product is introduced onto said intermediate layer drawn from the first roll and the absorbent base drawn from the second roll, wherein the absorbent base is added underneath both said fresh product and said intermediate layer, wherein a feed device for said absorbent base and a feed device for said intermediate layer comprise a guide, which is configured such that said absorbent base and said intermediate layer are drawn in between said product and the transport device from the respective separate first roll and second roll and transported along, wherein said intermediate layer is drawn from the first roll, wherein said absorbent base is drawn from the second roll, and wherein said first roll is upstream of said second roll in said direction of transport.

* * * * *